US009481557B2

(12) United States Patent
Lind

(10) Patent No.: US 9,481,557 B2
(45) Date of Patent: Nov. 1, 2016

(54) FORKLIFT BLADE ATTACHMENT

(71) Applicant: Rosati Window Co., LLC, Columbus, OH (US)

(72) Inventor: David Lind, Ashville, OH (US)

(73) Assignee: Rosati Window Co., LLC, Columbus, OH (US)

( * ) Notice: Subject to any disclaimer, the term of this patent is extended or adjusted under 35 U.S.C. 154(b) by 0 days.

(21) Appl. No.: 14/288,910

(22) Filed: May 28, 2014

(65) Prior Publication Data

US 2015/0259183 A1 Sep. 17, 2015

Related U.S. Application Data

(63) Continuation-in-part of application No. 14/203,920, filed on Mar. 11, 2014, now abandoned.

(51) Int. Cl.
*B66F 9/18* (2006.01)
*B66F 9/12* (2006.01)

(52) U.S. Cl.
CPC ..... *B66F 9/12* (2013.01)

(58) Field of Classification Search
CPC ..... B66F 9/12; B66F 9/18
USPC ..... 414/607, 785
See application file for complete search history.

(56) References Cited

U.S. PATENT DOCUMENTS

| | | | | | |
|---|---|---|---|---|---|
| 3,053,405 | A * | 9/1962 | Holmberg, Jr. et al. | ..... | 414/607 |
| 3,207,085 | A * | 9/1965 | Burr | ..... | 105/72.2 |
| 3,353,697 | A * | 11/1967 | Martin et al. | ..... | 414/607 |
| 3,791,544 | A * | 2/1974 | Moses | ..... | 414/607 |
| 4,669,949 | A * | 6/1987 | Sutton | ..... | 414/814 |
| 5,692,583 | A * | 12/1997 | Reed et al. | ..... | 187/237 |
| 7,597,526 | B2 * | 10/2009 | Benson | ..... | 414/607 |
| 2010/0189536 | A1 * | 7/2010 | Morgan et al. | ..... | 414/785 |

* cited by examiner

*Primary Examiner* — Jonathan Snelting
(74) *Attorney, Agent, or Firm* — Mueller Law, LLC; Jerry K. Mueller, Jr.

(57) ABSTRACT

Disclosed is an attachment for a fork of a forklift truck enabling the forklift truck to pull a pallet towards the forklift truck. At least one fork has a generally horizontal section extending away from the forklift truck and a generally vertical section adjacent to the forklift truck. The attachment has an elongate upside down U-shaped channel having a proximal end and a distal end for slipping onto the generally horizontal section of the fork of the forklift truck. The distal end of the attachment carries a U-shaped rod slippable over the generally vertical section of the fork. A troft is in the attachment near the proximal end. Upstanding teeth are retained by the attachment between the proximal end and the troft for retaining pallets so that the forklift truck can pull the pallet.

4 Claims, 2 Drawing Sheets

FORKLIFT BLADE ATTACHMENT

CROSS-REFERENCE TO RELATED APPLICATIONS

This application is a continuation-in-part of application Ser. No. 14/203,920 filed Mar. 11, 2014, the disclosure of which is expressly incorporated herein by reference.

STATEMENT REGARDING FEDERALLY SPONSORED RESEARCH

Not applicable.

BACKGROUND

The present disclosure relates to forklift trucks or forklifts and more particularly to an attachment that permits the forks to pull pallets and other objects.

Forklift trucks are commonly used to move and/or lift materials stacked on pallets, which are commonly constructed of wood. Often, the pallet or other object is positioned and/or located in a position such that the forklift operator is not readily able to insert the forks underneath the pallet. In such instances, forklift operators often try to pull the pallet towards them to be able to insert the forks underneath the pallet at the desired location.

Heretofore, German Patent No. 19729124 discloses a fork unit consisting of a vertical back and horizontal blade connected by a bend including hooks on the back for fixing to a fork carrier, including a blade extension fitting all round the blade, but not fixed to it wherein it can be fitted on the blade and moved along it. It can be locked in at least one extended position and another position close to the back, and it may consist of a rectangular-section tube with a cutout in the end facing the back.

U.S. Published patent application 2007/0170002 discloses a guard for positioning on a fork for a forklift or fork truck comprising a body or sleeve/guard configured to cover at least a portion of the bottom surface of the fork, with the body extending at least a portion of the length between the tip and the heel, and an attachment mechanism for holding the body onto the fork wherein the body could extend the entire length of the fork from the top to the heel, and/or could extend around and engage the heel of the fork U.S. Pat. No. 5,575,608 discloses a protective sheath for forklift tangs to protect plastic pallets and other structures from impact damage from contact with tang ends including a bumper at the distal end wherein a clamp surrounding the proximal end of the sheath and the tang securely holds the sheath and bumper onto the tang.

U.S. Pat. No. 5,692,583 discloses a handling device mounted on the lifting blades of a forklift truck and held in position by a safety chain including a frame with a pair of spaced support members.

As can be readily understood, none of these proposals enable the forklift operator to pull the pallet back towards the forklift truck. It is to such ability that the present disclosure is addressed.

BRIEF SUMMARY

Disclosed is an attachment for a fork of a forklift truck enabling the forklift truck to pull a pallet towards the forklift truck. At least one fork has a generally horizontal section extending away from the forklift truck and a generally vertical section adjacent to the forklift truck. The attachment has an elongate upside down U-shaped channel having a proximal end and a distal end for slipping onto the generally horizontal section of the fork of the forklift truck. The distal end of the attachment carries a U-shaped rod slippable over the generally vertical section of the fork. A troft is in the attachment near the proximal end. Upstanding teeth are retained by the attachment between the proximal end and the troft for retaining pallets so that the forklift truck can pull the pallet.

In a broader aspect, the disclosed attachment can be attached to the forks or tines of any vehicle that carries forks for use with pallets and other similar items. Thus, the use of "forklift truck" is to be interpreted broadly to cover any vehicle that carries forks or tines, including, for example, forklifts, front-end loaders, tractors, and other motorized vehicles.

BRIEF DESCRIPTION OF THE DRAWINGS

For a fuller understanding of the nature and advantages of the present method and process, reference should be had to the following detailed description taken in connection with the accompanying drawings, in which.

The drawings will be described in greater detail below.

DETAILED DESCRIPTION

Figure 1:
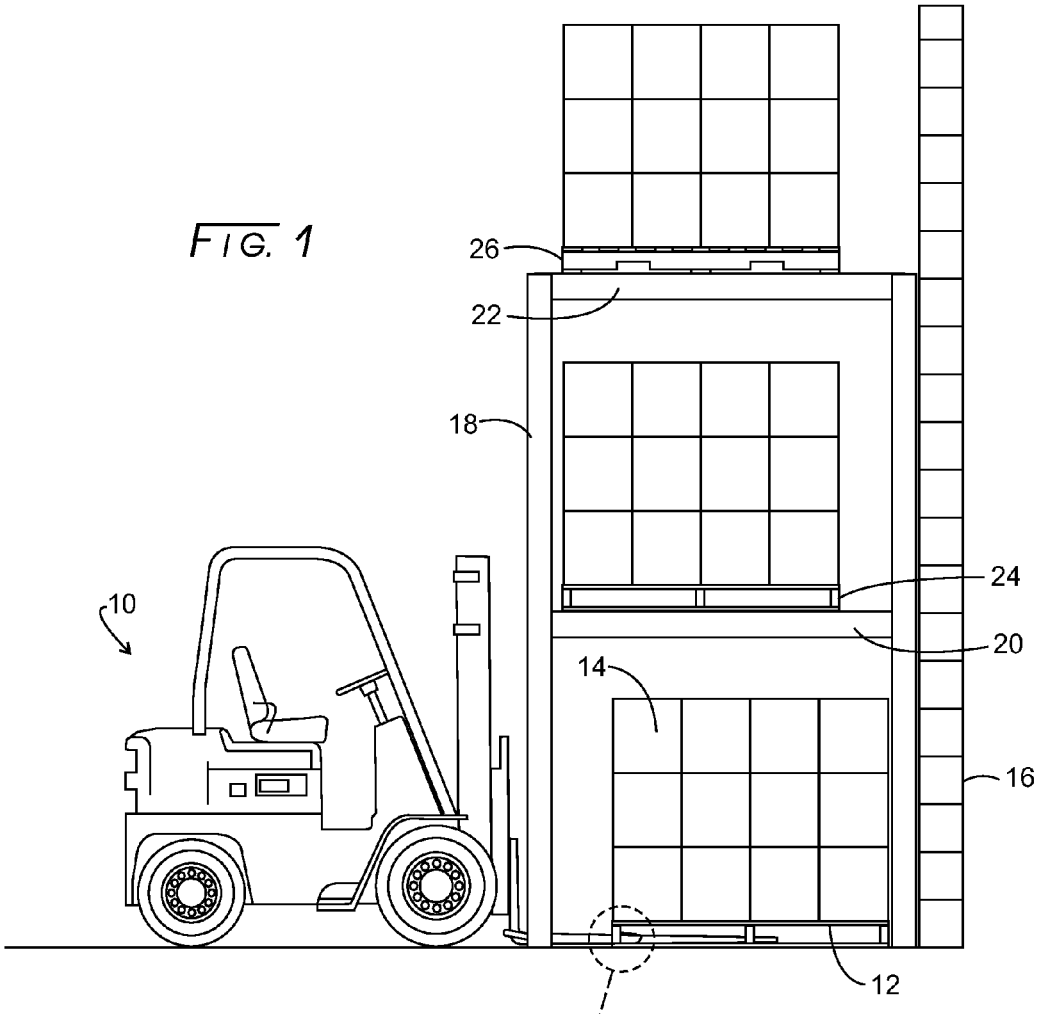
FIG. 1 is a side view of a forklift truck confronting a pallet located on the floor, where two shelves are located above such pallet and similarly contain pallets.

Referring initially to FIG. 1, a forklift truck, 10, is shown trying to lift a pallet, 12, carrying cargo, 14, and being pushed up against a wall, 16. Pallet 12 is located underneath a shelving unit, 18, having two overhead shelves, 20 and 22, that also carry pallets, 24 and 26, located directly above pallet 12, making it difficult for forklift truck 10 to get its forks inserted into pallet 12. Thus, the forklift operator needs to draft pallet 12 out from under shelving unit 18 in order to insert its forks to lift pallet 12. Unfortunately, the smooth forks cannot engage pallet 12 sufficiently to pull it out.

Figure 3:
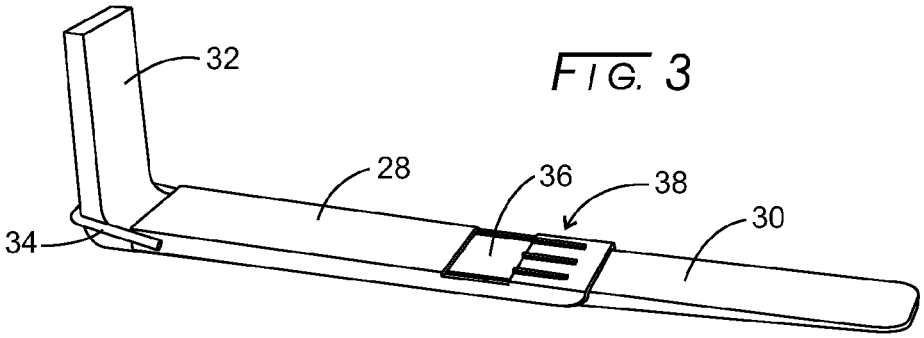
FIG. 3 is an isometric view of one of the forks of the forklift truck of FIG. 1 showing the disclosed attachment slipped over such fork.
Figure 4:
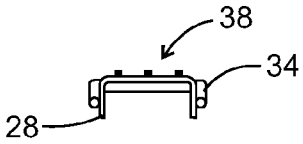
FIG. 4 is a front view of the disclosed attachment.

The disclosed attachment, 28 (see FIG. 3), has been slipped over one of the forks, 30, of forklift truck 10. As can be seen in FIGS. 3 and 4, attachment 28 is inverted U-shaped having a proximal end shown in FIG. 2 and a distal end adjacent to where fork 30 bends upwardly, 32. The distal end of attachment 28 carries a U-shaped rod, 34, that slips over generally vertical fork section 32 for retaining attachment 28 is position.

The proximal end of attachment 28 has an opening or troft, 36, near it. Located between troft 36 and the end of fork 30 are a series of generally upstanding teeth, 38. While 3 teeth are shown, such number of teeth can be greater or less than the number shown in the drawings.

Figure 2:
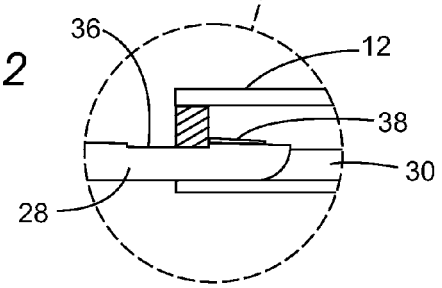
FIG. 2 is an enlarged view of the proximal end of the pallet and disclosed attachment that has been slipped onto one of the forks of the forklift truck and which attachment can grip the floor pallet to pull it.

In FIG. 2, it will be seen that a lower support board of pallet 12 fits down in troft 36 so that teeth 38 can engage such support board for the forklift operator to back up forklift truck 10 and pull pallet 12 out from under shelving unit 18. Should the pallet confronting forklift truck 10 be the adjacent side, such as for pallet 26, upstanding teeth 38 still are able to bite into the underside of the pallet for dragging it towards the forklift truck. It should be understood that, while a conventional wooden pallet illustrates the disclosed pallet's function, the disclosed attachment is capable to slipping under a variety of objects for pulling towards the forklift truck. Thus, the use of a pallet is by way of illustration and not limitation of the disclosed attachment.

Figure 5:
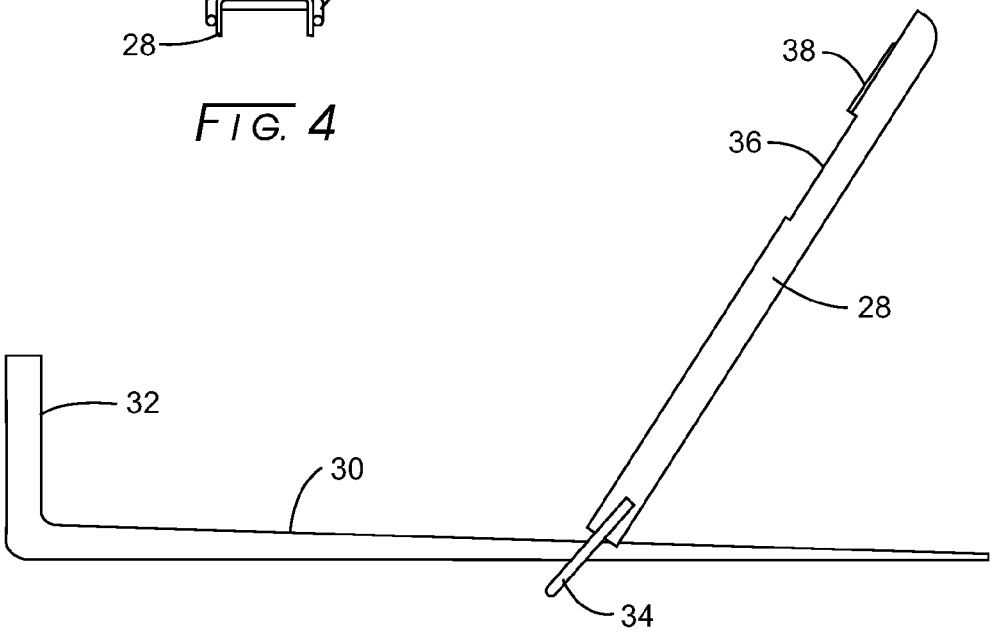
FIG. 5 is a side view of the fork of FIG. 3 showing the disclosed attachment being slipped over the fork.
Figure 6:
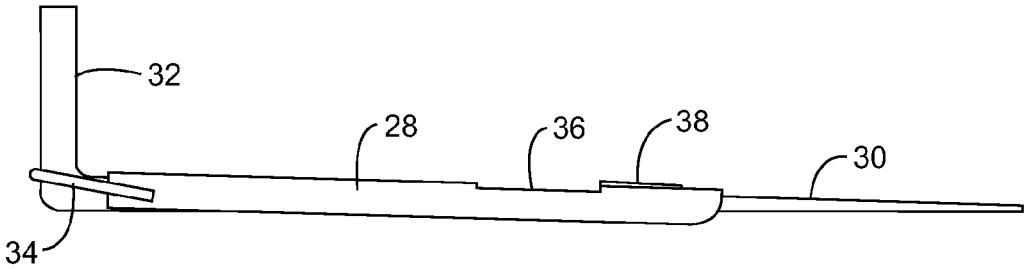
FIG. 6 is a side view of the fork and attachment of FIG. 3.

FIGS. 5 and 6 illustrate the method of attaching attachment 28 to a fork of forklift truck 10. Initially, U-shaped bar 34 is slipped over the proximal end of fork 30 and around generally upstanding section 34 for fork 30 to retain attachment 28 in position. Attachment 28, then is permitted to drop into position with its generally inverted U-shape fitting over fork 30. It should be noted that attachment 28 does not preclude standard operation of forklift truck 10 in its normal activities and operations. Thus, attachment 28 does not have to be removed once the desired pallet has been dragged out.

Attachment 28 most generally is made from metal with steel being preferred. That is not to say that attachment 28 could be made from plastic or other material, provided that such plastic or other material could withstand the rigors required of it in forklift operations. It also should be noted that while U-shaped bar 34 is illustrated as round in shape, other geometries can be used just as well.

While the device and method have been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. An attachment for a fork of a vehicle having forks enabling the vehicle to pull a pallet towards the vehicle, at least one fork having a generally horizontal section extending away from the vehicle and a generally vertical section adjacent to the vehicle, the attachment for one of the forks comprising:

(a) an elongate upside down U-shaped channel having a proximal end and a distal end for slipping onto the generally horizontal section of one fork of the vehicle;

(b) the distal end of the attachment carries a U-shaped rod slippable over the generally vertical section of one fork;

(c) an opening in the attachment near the proximal end and spaced-apart from the distal end;

(d) upstanding teeth disposed between the proximal end and the opening and sloped downwardly towards the proximal end for retaining pallets so that the vehicle can pull the pallet.

2. The attachment of claim 1, wherein the attachment is formed from metal.

3. The attachment of claim 1, wherein the upstanding teeth number 3.

4. The attachment of claim 1, wherein said vehicle is a forklift truck.

* * * * *